US005874811A

United States Patent [19]

Finlan et al.

[11] Patent Number: 5,874,811

[45] Date of Patent: Feb. 23, 1999

[54] SUPERCONDUCTING CYCLOTRON FOR USE IN THE PRODUCTION OF HEAVY ISOTOPES

[75] Inventors: Martin Finlan, Aylesbury; Edgar Lorch, High Wycombe, both of United Kingdom

[73] Assignee: Nycomed Amersham plc, United Kingdom

[21] Appl. No.: 793,651

[22] PCT Filed: Aug. 18, 1995

[86] PCT No.: PCT/GB95/01973

§ 371 Date: Jun. 20, 1997

§ 102(e) Date: Jun. 20, 1997

[87] PCT Pub. No.: WO96/06519

PCT Pub. Date: Feb. 29, 1996

[30] Foreign Application Priority Data

Aug. 19, 1994 [EP] European Pat. Off. ..... 94306146

[51] Int. Cl.[6] ..... H05H 13/00; H05H 7/08

[52] U.S. Cl. ..... 315/502; 315/505; 315/506; 313/62

[58] Field of Search ..... 313/62; 315/502, 315/506, 505; 335/216

[56] References Cited

U.S. PATENT DOCUMENTS

| | | | |
|---|---|---|---|
| 3,675,072 | 7/1972 | Hahn et al. | 315/111 |
| 3,833,469 | 9/1974 | Robson | 252/301.1 R |
| 3,899,681 | 8/1975 | Beckner et al. | 250/502 |
| 4,596,946 | 6/1986 | Pottier | 315/505 |
| 4,943,781 | 7/1990 | Wilson et al. | 313/62 |

FOREIGN PATENT DOCUMENTS

| | | | |
|---|---|---|---|
| 0338619 | 10/1989 | European Pat. Off. | H05H 6/00 |
| 2101681 | 3/1972 | France | H05H 5/00 |
| 2210879 | 7/1974 | France | H05H 7/00 |
| 2680941 | 4/1991 | France | H05H 7/08 |
| 5119196 | 5/1993 | Japan | G21G 1/10 |
| 1215599 | 9/1981 | U.S.S.R. | H05H 6/00 |
| 1030856 | 7/1983 | U.S.S.R. | G21G 1/10 |
| WO 86/07229 | 12/1986 | WIPO | H05H 13/00 |

OTHER PUBLICATIONS

Finn et al., "Ancillary Cyclotron Production of Technetium–95m for Clinical and Chemical Research," IAEA–CN–45/22 47–54 (no date).

Girit et al., "Unisor On–line Nuclear Orientation Facility," *AIP Conference Proceedings*, 849–852 (1988) (no month).

Goto et al., "Design of Injection System for the IPCR SSC (II)," *Sci. Papers I.P.C.R.* 74(4):124–145 (1980) (no month).

Kishida and Yano, "Beam Transport System for the RIKEN SSC (II)," *Sci. Papers I.P.C.R.* 75(4):214–232 (1981) (no month).

Vasilyev et al., "A Cyclotron Complex for Accelerating Multicharged Ions up to Relativstic Energies," *IEEE Transactions on Nuclear Science,* NS–26(2):2024–2029 (1979) (Apr.).

*Primary Examiner*—Sandra O'Shea
*Assistant Examiner*—Michael Day
*Attorney, Agent, or Firm*—Marshall, O'Toole, Gerstein, Murray & Borun

[57] ABSTRACT

A superconducting cyclotron is provided that includes a superconducting magnet. This superconducting magnet is arranged to provide a magnetic field that extends axially through a chamber which includes a radially extending beam space. There is further an interaction within the chamber between the axially extending magnetic field and RF energy that energizes particles that are circulating within the beam space. There is further a linear accelerator that is aligned with and exposed to the axially extending magnetic field of the superconducting cyclotron. The output of this linear accelerator communicates with an input to the beam space so that the particles for acceleration within the beam space are pre-accelerated by the linear accelerator.

4 Claims, 4 Drawing Sheets

SUPERCONDUCTING CYCLOTRON FOR USE IN THE PRODUCTION OF HEAVY ISOTOPES

BACKGROUND OF THE INVENTION

1. Field of the Invention

The present invention relates to a superconducting cyclotron of the type which does not include an iron yoke and separately to target apparatus and a method for producing isotopes such as technetium-99m utilising the ionised particles produced by a particle accelerator.

2. Description of the Related Technology

A yoke-less superconducting cyclotron, i.e. one which does not include an iron yoke, is described in EP 0221987 and is manufactured by Oxford Instruments under the name OSCAR*. The cyclotron consists of a superconducting magnet having a set of coils housed in a cryostat. The cryostat surrounds an inner chamber within which is located two sets of iron pole pieces, one above the other, between which is provided a beam space in which particles are accelerated. The pole pieces are arranged to interact with the magnetic field generated by the superconducting magnet to render the magnetic field isochronous with an azimuthal variation in strength. The particles are accelerated within the beam space by a large oscillating voltage which is applied across the beam space.

* Trade Mark

The development of such known yoke-less superconducting cyclotrons has significantly reduced the general bulk and weight of cyclotrons. However, such "compact" accelerators are limited in the maximum current of the particle beam which can be delivered. For example, the OSCAR* cyclotron is considered to have a theoretical maximum beam current limit of 500 $\mu$A for 12 MeV particles (the proton energy best suited for neutron radiography or as a PET isotope producer). One of the significant factors which limits any increase in beam current is the phenomenon known as space charge

* Trade Mark blow-up. This phenomenon is the tendency of like charged particles in a beam of ions to repel one another. Since this results in the axial dimension of the beam increasing, at higher currents the circulating particles in the beam have a tendency to strike the RF accelerating structures in the cyclotron. This phenomenon is most noticeable during the first few orbits of the particles in the beam space.

Even if higher beam currents could be obtained from such known cyclotrons, there is a further problem that at higher beam currents, where the ionised particles are to be used in direct production of technetium-99m by means of bombardment of an external target with the accelerated particles, it is difficult to extract the beam from the cyclotron and supply the beam to the target enclosure without causing contamination of the cyclotron with radioactivity from the target bombardment process. Use of a cooled thin exit window to screen the cyclotron from the radioactivity is only effective for beam currents up to approximately 200 $\mu$A.

In a conventional cyclotron target it is common for target material to be deposited onto a water cooled copper backing to provide a mechanism for conducting heat away from the target during bombardment by high energy charged particles, but this requires the isotopes produced to be extracted from the target by destructive chemical processing which prevents the target from being reirradiated. This method is therefore undesirable for $^{99m}$Tc production which involves many short irradiations due to the short half life and requires the use of expensive enriched target material which must be frequently recycled. Also, the production of $^{99m}$Tc on a commercial scale, for example for regional distribution to hospitals, requires the use of high power cyclotrons such as is described herein which have the capacity to deliver milliamperes of proton beam current to a target at energies up to 30 MeV. For example, in order to produce about 300 Ci/day of $^{99m}$Tc at end of bombardment a 3 mA beam current is required and the target assembly must be capable of withstanding up to 90 kW power.

Also, at high beam currents, to date difficulties have been encountered in extracting $^{99m}$Tc on-line from the expensive $^{100}$Mo target and ensuring the target material is retained or returned in a suitable target form.

SUMMARY OF THE INVENTION

The present invention seeks to overcome at least some of the problems referred to above and other such problems associated with known yoke-less superconducting cyclotrons and separately target apparatus. The present invention also seeks to provide a yoke-less superconducting cyclotron capable of delivering accelerated particles at much higher beam currents than formerly available. Separately, the present invention seeks to provide target apparatus which is capable of withstanding higher beam currents than are conventionally used in the production of isotopes such as $^{99m}$Tc. The target of this invention may be reirradiated a number of times without the need to chemically reprocess the expensive, highly enriched target material.

In a first aspect the present invention provides a superconducting cyclotron including superconducting magnetic means arranged to provide a magnetic field extending axially through a chamber including a radially extending beam space, interacting means located within the chamber to interact with the axially extending magnetic field and RF energising means for energising particles circulating within the beam space characterised by there being further provided a linear accelerator the output of which communicates with an input to the beam space whereby particles for acceleration within the beam space are pre-accelerated by the linear accelerator. In this way beam currents much higher than 500 $\mu$A can be generated.

In a preferred embodiment the linear accelerator is arranged so as to be aligned with and exposed to the axially extending magnetic field generated by the superconducting magnetic means. Preferably, the linear accelerator is mounted within the chamber about the central axis of the chamber. Also, the linear accelerator may be a Wideroe accelerator.

The present invention also provides a method of generating high energy particles comprising:

generating a magnetic field axially aligned with a chamber by means of superconducting magnetic means, adjusting the magnetic field within the chamber by means of interacting means to produce an azimuthal and an isochronous variation in the magnetic field with respect to the radial direction of the chamber, applying an RF oscillating voltage across a radially extending beam space in the chamber by means of RF energising means, injecting ionised particles into the beam space, accelerating the ionised particles within the beam space through the application of the RF oscillating voltage, characterised by pre-accelerating the ionised particles by passing the ionised particles through a linear accelerator before injecting the ionised particles into the beam space.

In a separate aspect the present invention provides a target for use in the production of isotopes comprising bombardment material supported by a support device so as to be in the path of a high current beam of accelerated particles and a containment device for containing at least a portion of the surface of the bombardment material in a low pressure environment, the support device providing substantially no thermal conduction from the bombardment material whereby cooling of the bombardment material is achieved radiatively.

Preferably, the containment device contains at least one gaseous reactive species at low pressure. The reactive species may be, for example, a halogen. This has the additional advantage that any volatilised bombardment material reacts with the halogen to form a halide. However, the halide will decompose at high enough temperatures which means that when the bombardment material halide contacts the target, which is at a very high temperature as a result of the bombardment by the accelerated particles, the halide decomposes thereby depositing the bombardment material back on the target. This enables less of the bombardment material to be lost.

Ideally the bombardment material is a refractory material.

The bombardment material may be in the form of a hollow structure or may be contained within a hollow casing of a refractory material. Alternatively, the bombardment material may be in the form of a thin sheet or sheets. The containment device may be a chamber containing the gaseous species. Where the bombardment material or the refractory material is in the form of a hollow structure, the containment device may be in the form of valve means provided at each end of the hollow structure.

The present invention further provides a method of producing an isotope comprising the steps of: providing bombardment material on a support device with at least a portion of the surface of the bombardment material being contained in a low pressure environment; focussing a high current beam of accelerated particles on the portion of the bombardment material; at the same time or subsequently introducing a gaseous reactive species into the low pressure environment; and at the same time or subsequently collecting the heavy isotope produced, wherein substantially no heat is conducted away from the bombardment material by the support device during exposure of the bombardment material to the beam and the bombardment material is cooled radiatively.

In a preferred embodiment the bombardment material consists of or includes $^{100}$Mo and the isotope produced is $^{99m}$Tc.

With the target and method described the heat generated in the desired isotope producing reaction is decoupled from the heat generated in stopping the high current beam. It is possible for the target to be irradiated many times, or continuously, at high power and for the isotope produced to be extracted without destroying the target. This also enables the amount of target processing to be minimised as well as the frequency of recycling.

BRIEF DESCRIPTION OF THE DRAWINGS

Embodiments of the present invention will now be described, by way of example only, with reference to the accompanying drawings, in which.

DETAILED DESCRIPTION OF THE INVENTION

Figure 1:
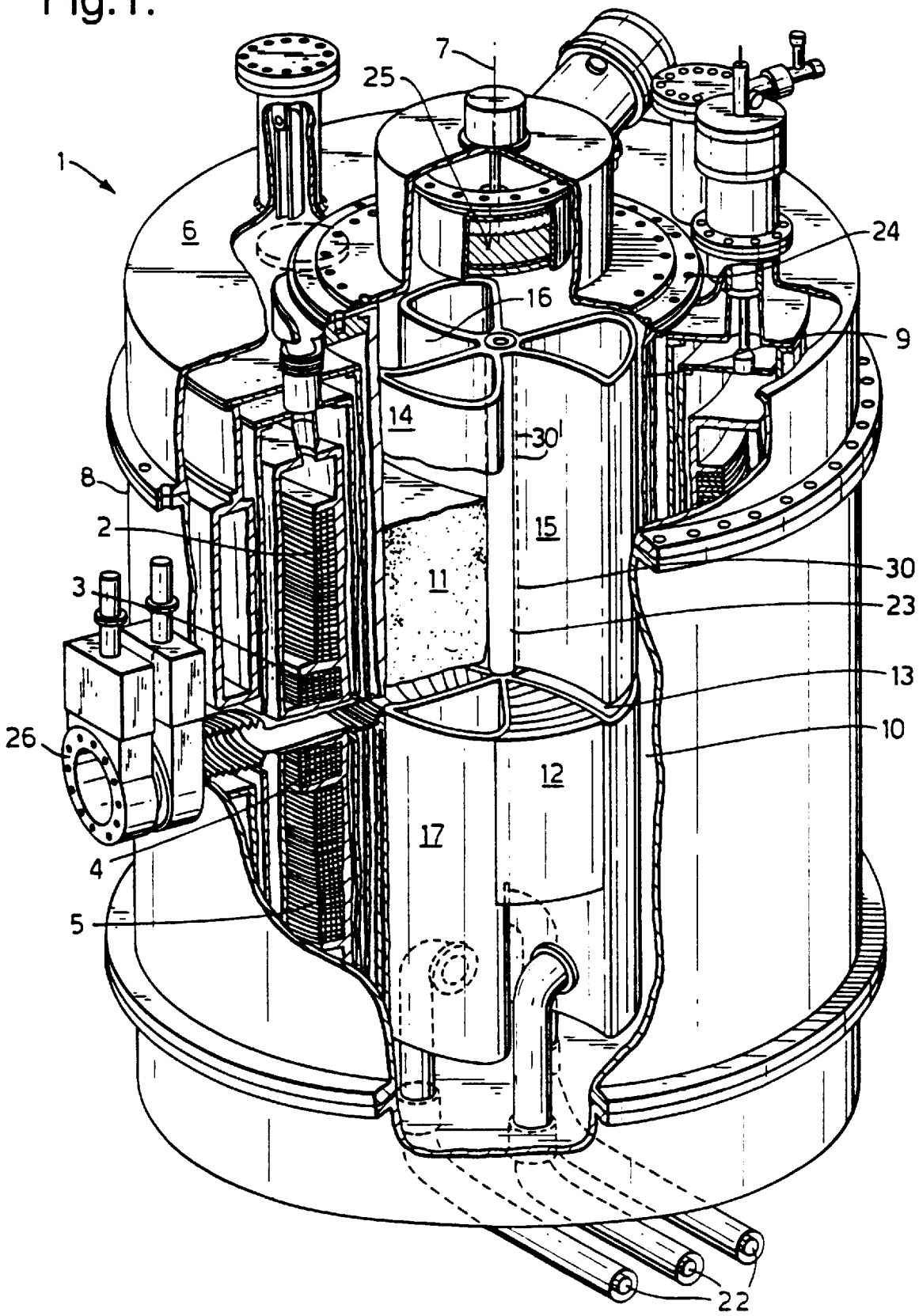
FIG. 1 is a cut away perspective view of a superconducting cyclotron in accordance with the present invention.

In FIG. 1 a yoke-less superconducting cyclotron 1 is shown which is similar to the cyclotron described in EP 0221987, the contents of which is herein incorporated by reference.

The superconducting magnet of the cyclotron 1 is in the form of four superconducting magnet coils 2, 3, 4, 5 which are housed in a cryostat 6. In this way the coils 2, 3, 4, 5 are kept as near to zero kelvin as possible to maintain the superconducting characteristic of the coils. The coils 2, 3, 4, 5 are arranged so as to generate a constant axial magnetic field which extends parallel to a central axis 7 of the cyclotron.

The cryostat 6 is generally cylindrical in shape and has an outer wall 8 which surrounds the superconducting magnet coils 2, 3, 4, 5 and an inner wall 9, concentric with the outer wall 8, which is located within the radius of the coils 2, 3, 4, 5. The inner wall 9 defines an axially extending chamber 10 within which the magnetic field generated by the superconducting magnet coils extends axially. The cryostat 6 is not described in detail herein, being of conventional construction.

Within the chamber 10, two sets of soft iron pole pieces 11, 12 are provided, one above the other, with each set consisting of three separate generally sector shaped pole pieces which are arranged at 120° intervals about the central axis 7 of the cyclotron 1. Each of the pole pieces in the first set 11 are axially aligned with a respective one of the pole pieces in the second set 12. The shape, disposition and magnetic properties of the pole pieces 11, 12 are selected to provide a desired variation radially in the strength of the magnetic field. The pole pieces 11, 12 enable an isochronous magnetic field shape with azimuthal variation to be established within the chamber 10.

The two sets of pole pieces 11, 12 are axially separated from one another by an amount which is small in comparison to the size of the chamber 10, to define therebetween a beam space 13 which extends outwardly radially from the central axis 7 of the cyclotron 1. It is within this beam space 13 that the particles are accelerated by circulating about the central axis 7 in a substantially spiral path, normal to the axial magnetic field.

Interposed between each of the pole pieces of each set are radio frequency cavity resonators 14, 15, 16, 17. Thus, three upper RF cavity resonators 14, 15, 16 are provided at 120° intervals about the central axis 7 of the cyclotron in between the pole pieces 11 and three lower RF cavity resonators 17 (only one of which is shown) are provided, axially aligned with the upper RF cavity resonators.

Figure 2:
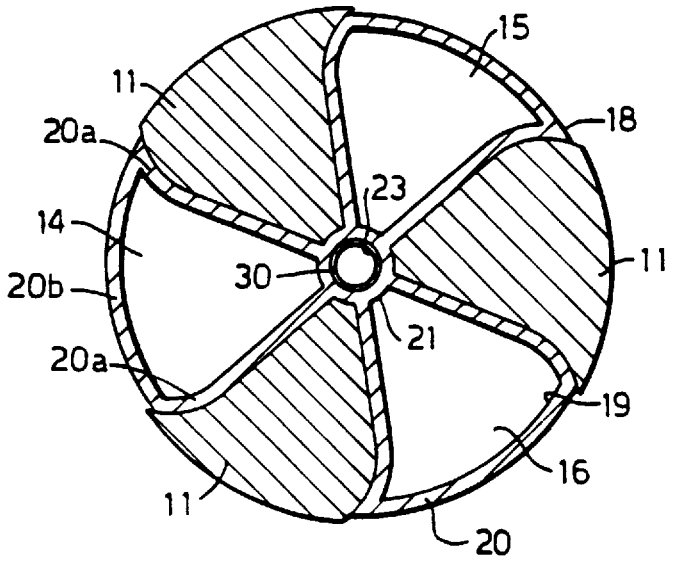
FIG. 2 is a cross-sectional plan taken above the beam space in the cyclotron of FIG. 1.

The upper set of RF cavity resonators 14, 15, 16 can be seen in more detail in FIG. 2. Each of the RF cavity resonators 14, 15, 16, 17 are generally sector shaped and have an outer cavity wall 18 and an inner cavity wall 19 positioned within the outer cavity wall 18. Between the two cavity walls 18, 19 a narrow RF cavity 20 is defined. Each of the cavity walls 18 and 19 are preferably made of copper. The corners 21 of the cavity resonators adjacent the central axis 7 of the cyclotron 1 of each set of resonators are either integral or connected so that the RF cavities 20 of the upper set of cavity resonators communicate with one another as do the cavities of the lower set. Each RF cavity 20 is arranged to include two approximately radially extending channels 20*a* and a circumferentially extending channel 20*b* which connects the two radially extending channels 20*a*. The channels 20*a*, 20*b* extend axially so as to provide the desired energisation to the circulating particle in the beam space 13. For example, the channels 20*a*, 20*b* may be made so as to correspond in axial length to one quarter wavelength of the desired radio frequency and may be closed at the ends of the channels 20*a*, 20*b* distant from the beam space 13, whereby the cavities 20 function as quarter wave resonators. The RF energisation is fed to the cavities 20 in any suitable conventional manner, for example by means of coaxial cables 22. In this way a large oscillating voltage is established at the openings of the cavities 20 either side of the beam space 13. Preferably, all of the cavities 20 in the upper set of cavity resonators are energised in phase and similarly the lower set at a frequency which is a multiple of, for example three times, the frequency of revolution of the particles in the beam space 13.

The lower set of sector shaped pole pieces 12 and sector shaped cavity resonators 17 converge on the central axis 7 of the cyclotron 1. In so far as the upper set of pole pieces 11 and cavity resonators 14, 15, 16 are concerned, a cylindrical wall 23 is located about the central axis 7 of the cyclotron which functions firstly to ensure the cavities 20 of the upper set of cavity resonators are in communication with one another and secondly as a shield around the path taken by the particles to the beam space 13. Within the cylindrical wall 23 and concentric with the wall is an RF linear accelerator 30. The accelerator 30 is only approximately 2 cm in diameter but enables particles to be inflected into the beam space 13 at 1 MeV or more. Thus, the linear accelerator 30 is provided to pre-accelerate the particles before injection into the beam space of the cyclotron.

Preferably the RF linear accelerator is a Wideroe accelerator and consists of a plurality of cylinders 30' or drift tubes coaxially aligned, each separated by an equal amount and each having a length which varies in dependence on its position within the cyclotron 1. The linear accelerator 30 utilises the axially aligned magnetic field established within the chamber 10 to focus the particles prior to their injection into the beam space 13. The length of each of the cylinders 30' increases by an amount proportional to the square root of a series of integers, with the smallest cylinder being located nearest the cover member 24 of the cyclotron and the largest cylinder being located nearest the beam space 13. Each of the cylinders 30' are held in position by means of connecting members (not shown) between the cylinders 30' and the support frame 23. In a manner similar to that of the cavity resonators 14, 15, 16, 17 an RF power source is connected to each of the cylinders 30', for example by means of a coaxial cable (not shown) so that adjacent cylinders or electrodes are driven out of phase with one another and alternate cylinders are in phase with one another. For ease of reference the individual cylinders 30' are not shown to scale in FIG. 2 and instead have been enlarged. Preferably the RF source for the linear accelerator 30 operates at the same frequency as the RF source for the cavity resonators, e.g. 150 MHz. Between the end of the linear accelerator 30 and the beam space 13 means, for example a helical inflector, is provided to inflect the accelerated particles from the linear accelerator 30 into the beam space 13.

The linear accelerator 30 is preferably approximately 1 m in length when mounted in a yoke-less superconducting cyclotron such as the OSCAR cyclotron. With a 1 m linear accelerator 30, 1 MeV of ionised particles can be inflected into the beam space 13. With an average magnetic field of 2.36 tesla, the ionised particles will be inflected through a radius of approximately 7 cm on the median plane or through a radius of approximately 5 cm with an average magnetic field of 3 tesla. The current of the resultant beam of accelerated particles from the cyclotron 1 can be increased, in this way, to as much as 10 mA.

Moreover, since the intense axial magnetic field of the cyclotron 1 is applied to the linear accelerator 30, problems with the focussing of the particles in the accelerator 30 are ameliorated. Of course, preferably, the external field cancelling coils provided with superconducting cyclotrons would be dispensed with. Also, the linear accelerator 30 may be positioned at the end of the cylindrical wall 23 distant from the beam space 13 and thereby beyond the upper sets of pole pieces 11 and RF cavity resonators 14, 15, 16. For the sake of compactness, it is preferred that the linear accelerator 30 be positioned within the cylindrical wall 23.

An additional advantage which the use of a linear accelerator provides, is the ability to contain or even reduce the diameter of the cyclotron because the magnetic field can be increased. For example, with an average magnetic field of 3 tesla, 20 MeV particles have an orbit radius of 21 cm, whereas with the conventional cyclotron, approximately the same orbit radius, 20 cm, is present for 12 MeV particles. Even with the higher magnetic field, Lorenz stripping of the ionised particles is only about 0.2 percent and is therefore not a problem. When the particles are inflected into the beam space 13 at 1 MeV, the radius of the first orbit of the accelerating particles is approximately 5 cm. With a conventional superconducting cyclotron, e.g. the OSCAR cyclotron, the first orbit radius is very tight at only 2.6 cm.

The particles are fed to the linear accelerator 30 from an ion source 25. The ion source 25 is preferably mounted externally on the cover member 24 of the cyclotron. The ion source 25 is any suitable conventional ion source and its output is connected to the input end of the linear accelerator, distant from the beam space 13. The ion source 25 can be used to deliver either positive or negative ions. In either case the means of extracting the accelerated particles from the beam space 13 is conventional. For example, where the particles are negative ions, a thin carbon foil may be placed in the path of the spiralling particles. The foil strips the negative charge from the ions thereby rendering them positively charged. The particles are as a result deflected by the axial magnetic field outwardly through a delivery port 26. On the other hand, if the particles are positive ions, the magnetic field is adjusted to deflect the particles in an outer orbit towards an electrostatic deflector which in turn causes the particles to pass through the delivery port 26 which in this case would be arranged tangential to the path of the orbiting particles. If the foil life is unacceptably short at negative ion currents beyond one mA, septum extraction can be employed as for positive ions. This can be more effective for negative ions in that protection of the critical entrance region of the septum can be provided by using eg carbon fibre as a means of stripping and deflecting the small proportion of ions which would have struck the septum nose.

Hence, by accelerating the particles to 1 MeV or more prior to their inflection into the beam space 13, beam currents far in excess of the present operating current limits of conventional superconducting cyclotrons can be achieved. Moreover, by utilising a linear accelerator to pre-accelerate the particles, the magnetic field already present in the cyclotron can be utilised.

As discussed above, by including a pre-accelerator with the yoke-less superconducting cyclotron described above, much higher beam currents of accelerated particles can be obtained. In FIGS. 3 to 7 target apparatus for the generation of heavy isotopes such as $^{99m}$Tc are shown which are capable of withstanding mA beam currents.

In all of the embodiments described and shown the target is mounted in such a manner as to enable the target material to cool radiatively rather than, as has been the case conventionally, to cool through conduction by virtue of the presence of a heat sink in thermal contact with the target. Most but not all of the embodiments described provide the additional advantage that the isotope produced by the bombardment of the target material with high energy charged particles can be collected without destruction of the target. The heat generated in the desired reaction is decoupled from the heat generated in stopping the high current beam. This is possible as the target materials used are refractory i.e. materials with a high melting point for example in excess of 2000° C. and low vapour pressures (for example less than 10 mbar at 1000° C.).

Figure 3:
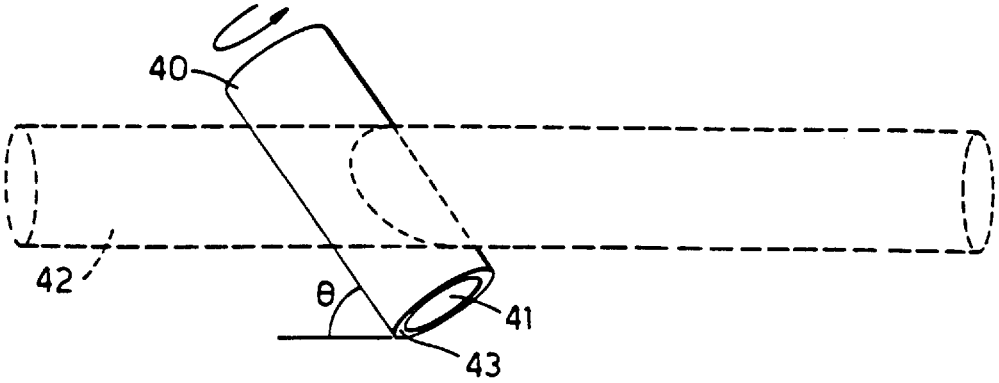
FIG. 3 shows schematically a first embodiment of a target in accordance with the present invention.

In FIG. 3 a target 40 is shown on which is incident a beam 42 of high energy charged particles which may have been generated using the cyclotron described earlier but not necessarily. The target 40 is hollow and in this example is tubular in shape and positioned so as to intercept the beam 42 at an angle θ. Since the target 40 is tubular, the target has greater mechanical rigidity and being hollow it is possible for the target to cool radiatively from both the outer walls. If necessary, additional cooling of the target can be performed by circulating a cooling gas through the conduit 41 defined by the inner walls of the tube target.

The outer wall of the target may also be coated with an inert element or compound 43 which functions as a barrier to diffusion and evaporation of volatile species from the outside of the target. Instead the isotope produced by the bombardment of the target material by the beam is volatilised from the inner wall of the tube target and is collected from the conduit 41. Vacuum seals (not shown) may be secured to each end of the tube target 40 so as to control the gaseous environment and pressure within the conduit 41.

As indicated in FIG. 3 the tube target 40 may be mounted on a support (not shown) which enables the tube target 40 to be rotated. This provides for a more uniform time averaged power load over the target surface. Alternatively rotation of the tube target 40 may be performed to expose fresh surfaces of the target 40 to the beam 42 over a succession of production runs. Very little if any heat is conducted away from the target by means of the support.

In the case of $^{99m}$Tc production, the target material is molybdenum-100. Since $^{100}$Mo has a melting point of 2617° C. it is possible for the target 40 to be used in the commercial production of bulk $^{99m}$Tc for medical use at a high enough temperature, e.g. 2000° C. so that self cooling by radiative energy loss is performed. At or above 2000° C. the radiative cooling from the surface of the $^{100}$Mo target may be as high as 0.336 MW/m$^2$ which permits a compact target geometry with a 3 mA, 30 MeV proton beam which delivers in the region of 10 MeV energy and 30 kW of power to the target 40.

In use, valved seals are provided at each end of the $^{100}$Mo tube target 40 which includes an inert coating 43 on its outer wall. Chlorine or another reactive gas, preferably a halogen, may optionally be circulated at low pressure through the conduit 41 via the valved seals, either during or after irradiation. The chlorine preferentially reacts with the technetium formed on the inner wall of the tube target 40 to produce a volatile technetium species which is carried by the circulating chlorine out through the valved seals to be subsequently condensed and collected in a cold finger 45 remote from the target 40. Continuous condensation of pure $^{99m}$Tc halide will occur in the cold finger 45 when the vapour pressure in the cold finger is lower than the $^{99m}$Tc partial pressure at the hot region of the target.

In an alternative arrangement the tubular structure of the target 40 may be constructed of a separate refractory material such as tantalum which has a high melting point. The tantalum tube acts as a container for the $^{100}$Mo target material which is located within the conduit 41 in the form of a porous matrix. This has the advantage that the container enables operation of the target at a higher temperature than would be possible with molybdenum alone and prevents excessive volatilisation of isotopes into the vacuum system of the accelerator which generates the proton beam. Heat loss by radiation is also maximised as is the internal operating temperature which ensures the $^{99m}$Tc produced is volatile and labile within the target 40.

Hence, with this alternative arrangement a highly porous form of $^{100}$Mo having a high surface area to volume ratio may be used which is in the form of a loosely packed, partially sintered powder or in the form of a wool. With such a form of the target material the distance through which the $^{99m}$Tc must diffuse before the $^{99m}$Tc can volatilise is minimised. This increases the volatilisation rate of the $^{99m}$Tc and/or lowers the temperature required to carry out the volatilisation. Furthermore, the surface area of contact between the target material and a cooling gas is maximised where cooling of the target material with helium or an alternative inert gas is required whilst the proton beam is incident. The cooling gas may also be used as the carrier gas for reactive compounds such as a halogen, $H_2O$ or $O_2$ and/or other species. Where a halogen extraction process is not utilised, this arrangement has the additional advantage that the porous form of the target material will more rapidly dissolve in an alternative solution chemistry process. The porous form of the target material may also be an easier form to reproduce in a recycling process.

By using an alternative chemical form of the target material, $^{99m}$Tc may be volatilised at a much lower temperature in the form of $^{99m}Tc_2O_7$. In order to volatilise $^{99m}Tc_2O_7$ from a cyclotron target the target material should contain a high proportion of molybdenum to maximise production yield and also have a high surface area, and preferably be porous and amorphous to allow good contact with the gas phase to enable volatile $^{99m}Tc_2O_7$ to be released into a carrier gas stream. Hence, the production of $^{99m}Tc_2O_7$ lends itself to the use of a target in which the target material is contained within a hollow casing of a refractory material.

Several mixed oxide binary, ternary or quaternary phases containing a high proportion of molybdenum with ill-defined or disordered structures are known. Many of these contain molybdenum either as molybdate or as complex heteropolyanions in conjunction with other elements. As it is desirable to minimise the production of radioactive byproducts from such mixed element targets the other elements should preferably not be appreciably activated by 30 MeV protons. Such elements may include niobium, nickel, calcium, potassium, aluminium, phosphorous, silicon, magnesium, beryllium and boron. But other elements can be contained in the target if the radioactive byproducts are not volatile and/or can be easily separated from $^{99m}$Tc.

Titanium molybdate gel is one example of a potentially suitable target material although in this case $^{48}V$ and $^{49}V$ byproducts will also be produced. This material can be produced in an amorphous, high surface area form which is probably better described as titanyl molybdate subhydrate with an approximate formula of $TiO.MoO_4.\ xH_2O$. It is known to be an effective target material for $^{98}Mo(n,)^{99}Mo$ sublimation generators. It is also known that volatile $^{99m}Tc_2O_7$ gas freely sublimes from this target material at or above 385° C. It has been postulated that this material undergoes a reversible physicochemical transformation close to 385° C. which releases $^{99m}Tc_2O_7$ from the bulk structure into the gas phase in a stream of moist air. The postulated physicochemical transformation may be reversible hydration/dehydration.

A wide choice of potential target materials for the production of $^{99m}Tc$ is possible and titanium molybdate may not necessarily provide the optimum conditions. Molybdenum trioxide ($MoO_3$) for example which is known to release $^{99m}Tc_2O_7$ gas above about 650°–750° C. could also be used as a target for the p,2n reaction without producing unwanted byproducts. As already mentioned there may be several other complex mixed oxides or other compounds with suitable properties.

In a mixed element target preferably not less than 25% of the target material would be highly enriched $^{100}Mo$. The production yield of $^{99m}Tc$ from such a target by the p,2n route would then be about 2.5 mCi/$\mu$Ahr in the 18–10 MeV range, this is one quarter of the yield calculated for 100% pure $^{100}Mo$ metal. The 18–10 MeV energy range is a representative case for PET cyclotrons which are of potential interest for local $^{99m}Tc$ production however this invention is not limited to PET machines and a larger yield is obtained with higher energy machines.

Using an 18 MeV 100 $\mu$A PET cyclotron the daily production of $^{99m}Tc$ is ≈1.25 Ci after a single 6 hr run. One half life decay and 25% production loss before use would yield 500 mCi/day of injectable $^{99m}Tc$. This is sufficient for the maximum demand expected within a large nuclear medicine department which may carry out 20×15 mCi procedures per day. This target concept is therefore potentially attractive for continuous or repeatable local production with PET cyclotrons. Minimal target handling and chemistry is required by the operator and decay loss is also minimised.

In addition to the presence of low density, high surface area molybdenum inside the target the same or similar form of molybdenum or another metal can be placed off beam, in a cooler part of the assembly, to act as a filter onto which molybdenum halide vapour can condense and dissociate, depositing Mo metal. This may occur at a temperature at which the gaseous Mo halide is unstable to dissociation but at which gaseous $^{99m}Tc$ halide remains stable and exists as an associated gaseous molecule. The temperature of the filter should preferably be about 1000° C. at which Mo halide dissociation and Mo deposition from the vapour phase is thought to be rapid. Under these conditions if $^{99m}Tc$ halide vapour is stable to dissociation it will pass through the filter where it can be collected in a cold finger.

Figure 4:
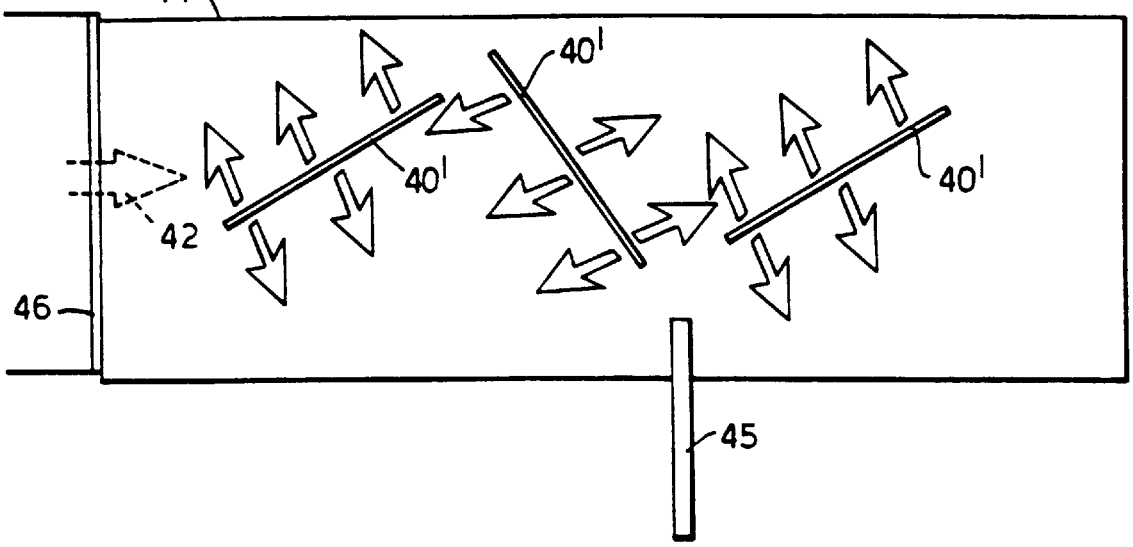
FIG. 4 shows schematically a second embodiment of a target in accordance with the present invention.
Figure 5:
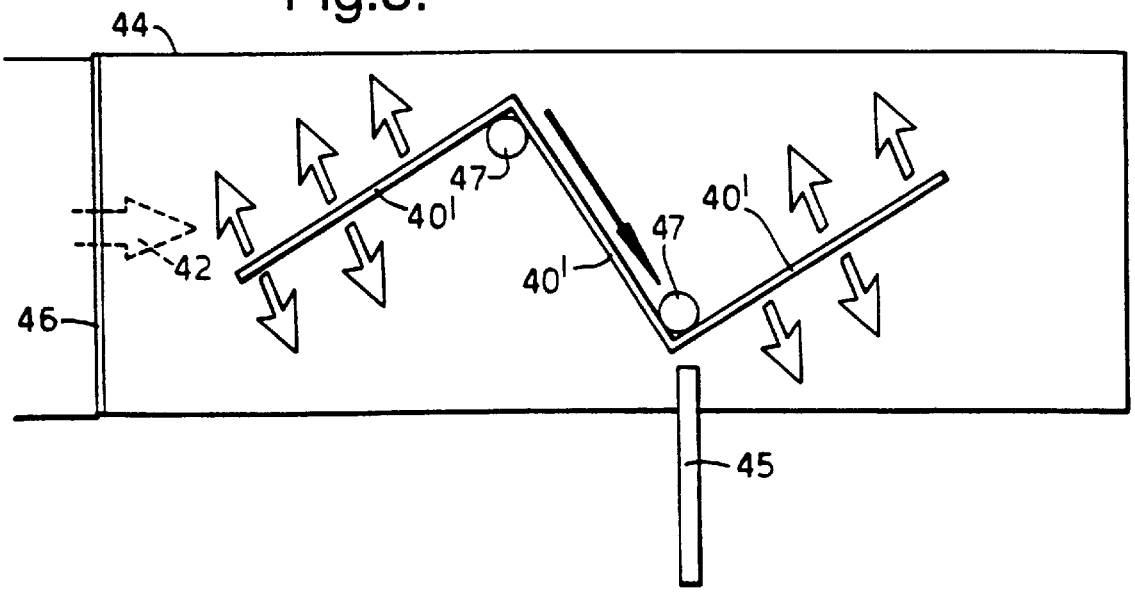
FIG. 5 shows schematically a third embodiment of a target in accordance with the present invention.
Figure 6:
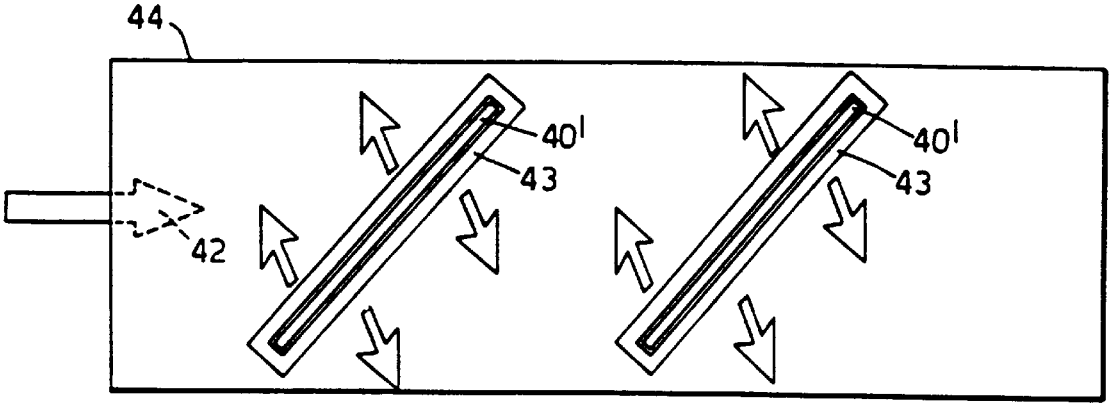
FIG. 6 shows schematically a fourth embodiment of a target in accordance with the present invention.

Turning now to FIGS. 4, 5 and 6, the target 40 in this example is a plurality of foil targets 40'. The targets may be separate or may be a unitary foil arranged so that a plurality of regions of the foil are separately exposed to the beam 42. Hence, as shown in FIG. 5, the foil target may be concertinaed. In FIG. 5 the concertinaed target is mounted on rollers 47 thereby enabling the region of the target exposed to the beam to be varied in a manner similar to the rotation of the target of FIG. 3. The target 40 may be a laminar or sandwich construction containing other materials which impart the desired physical and chemical properties to enable the target to withstand bombardment by a high energy beam of charged particles such as a proton beam. The overall thickness of the foil of the target and angle of the target to the beam direction is chosen to achieve the desired energy drop across the entire target which in the case of $^{99m}Tc$ production with a 3 mA beam is about 10–15 MeV with an incoming energy between about 30–20 MeV depending on the cyclotron being used and the isotopic enrichment of the $^{100}Mo$ target material. The arrows in the Figures represent the radiative cooling of the target. Very little if any heat is conducted away from the target foil via the target support. At a temperature of 2000° C. a $^{100}Mo$ foil will radiate approximately 0.366 MW/m$^2$. Therefore to dissipate around 30 kW by radiative losses alone the surface area of the target would need to be 0.082 m$^2$. This can be achieved in a variety of arrangements:

(i) a single foil 0.0244×100×410 mm inclined at 14° to the axis of the beam;

(ii) two foils, each 0.0244×100×205 mm inclined at 29° to the axis of the beam; or (iii) three foils, each 0.0244×100×137 mm inclined at 47° to the axis of the beam.

Each of these variations means that an area of 100 mm×100 mm is presented to the incident proton beam. This size, which may be controlled by beam shaping elements such as scanning magnets and quadrupoles is convenient for irradiation by a typical proton beam extracted from a cyclotron.

Since molybdenum is reactive at high temperature in the presence of an oxidising gas such as oxygen or air the target is mounted within a chamber 44 with a high vacuum and a very low partial pressure of such oxidising gases to enable the foil target assembly to be operated at high temperature without rapid oxidation and volatilisation of the target material.

Significant loss of target material during bombardment due to evaporation can occur unless attention is given to optimising the heat radiated from the target. This effect is reduced by increasing the exposed surface of the target available for radiative energy loss which is achieved by increasing the number of foil targets 40' bombarded by the beam, by tilting the foils to an angle θ with respect to the beam direction and by reducing the thickness of the individual foil target 40' to maintain the same total energy drop over the whole target. Especially where the foil thickness is reduced, the target can be afforded greater mechanical strength and rigidity by profiling the surface of the foils 40' with dimpling or corrugation.

Alternatively, to reduce evaporation the foil target may have a sandwich construction in which the target material is encapsulated in a non-volatile refractory material such as silicon or molybdenum silicate 43. This provides an inert diffusion barrier similar to the one described earlier with reference to FIG. 3. Although the coating of the refractory material reduces the evaporation rate of the target material thereby enabling the target to be used at higher temperatures, where the target is a foil, the coating also prevents $^{99m}Tc$ volatilisation. In these circumstances the $^{99m}Tc$ can only be extracted by destructive chemical dissolution of the target material.

The target materials discussed above may be employed with the targets of FIGS. 4, 5 or 6.

A thin beam line foil 46 may be used to separate the target 40 and the interior of the chamber 44 from the accelerator.

The beam line foil 46 is thin enough to absorb minimal beam energy ensuring the temperature of the beam line foil is significantly lower than the temperature of the target foils.

The beam line foil is used as a means to contain a low vapour pressure of reactive species in the target chamber in contact with the target. For example, in the case of $^{99m}$Tc production the reactive species might be a halogen and the beam line foil material is chosen so as not to react with the vapour in the chamber at the temperatures encountered during bombardment. The reactive species present in the target chamber may also be used to suppress the evaporation of the target material, i.e. the reactive species may include molybdenum halide vapour.

The walls of the chamber 44 must be able to absorb the radiant energy emitted by the foil target, which may be around 30 kw. If halogen or halide gas is used in the chamber to minimise target volatilisation, the chamber surface must also be chemically inert. For the halide process to work efficiently it is necessary for the walls of the target chamber to be maintained at a moderate temperature between about 300°–1000° C. to ensure that any molybdenum which condenses on to the chamber walls will react with halogen in the gas phase and produce volatile molybdenum halide gas which will be transported back to the target where it will decompose when it comes in contact with the hot target surface and redeposit molybdenum metal back onto the target.

It is preferable for the internal walls of the chamber to be constructed of (or coated with) a material such as fused silica which is substantially transparent to the radiant energy spectrum emitted by the target, is chemically inert and enables the internal chamber surface to be maintained at the optimum temperature for the halide process to work. It is preferable for the external surface of the fused silica chamber (or coating) to be non-reflecting and thermally conducting to maximise energy absorption which may be conducted away from the walls by water cooling pipes.

Turning now to FIG. 7, the target 40 is again in a thin sheet or foil form. A substantially constant magnetic field is generated of approximately 1 tesla in the target region orthogonal to the drawing and acts to bend the charged particle beam 42, having a mA beam current, so that it irradiates the target obliquely. The chamber 44 contains a near vacuum environment with, for $^{99m}$Tc production, a halogen or other suitable volatile element or compound may be present at low pressure. In use, a plasma is formed above the target 40 with the evaporated molybdenum and technetium which is contained by the magnetic field. The molybdenum is returned to the target whereas the $^{99m}$Tc is collected by a collector matrix 50 mounted within the chamber 44 on a support (not shown).

The collector matrix 50 may be in the form of two parallel plates or a cylinder with an aperture in its wall through which the beam 42 passes. At one end of the collector matrix 50 the target 40 is positioned so as to be surrounded by the collector matrix 50. For $^{99m}$Tc production, the collector matrix 50 consists of glass wool which may, in addition, be coated with sodium carbonate. The vacuum chamber 44 has an input corridor 51 at each end of which are mounted aluminium baffles 52. When in use, the beam 42 of accelerated particles having a beam current of 1 mA or more is directed along the input corridor 51 and is bent by the magnetic field so as to be incident on the target. Through a further port 53 the collector matrix 50 is removed to obtain the $^{99m}$Tc which has been collected on the matrix.

Figure 7:
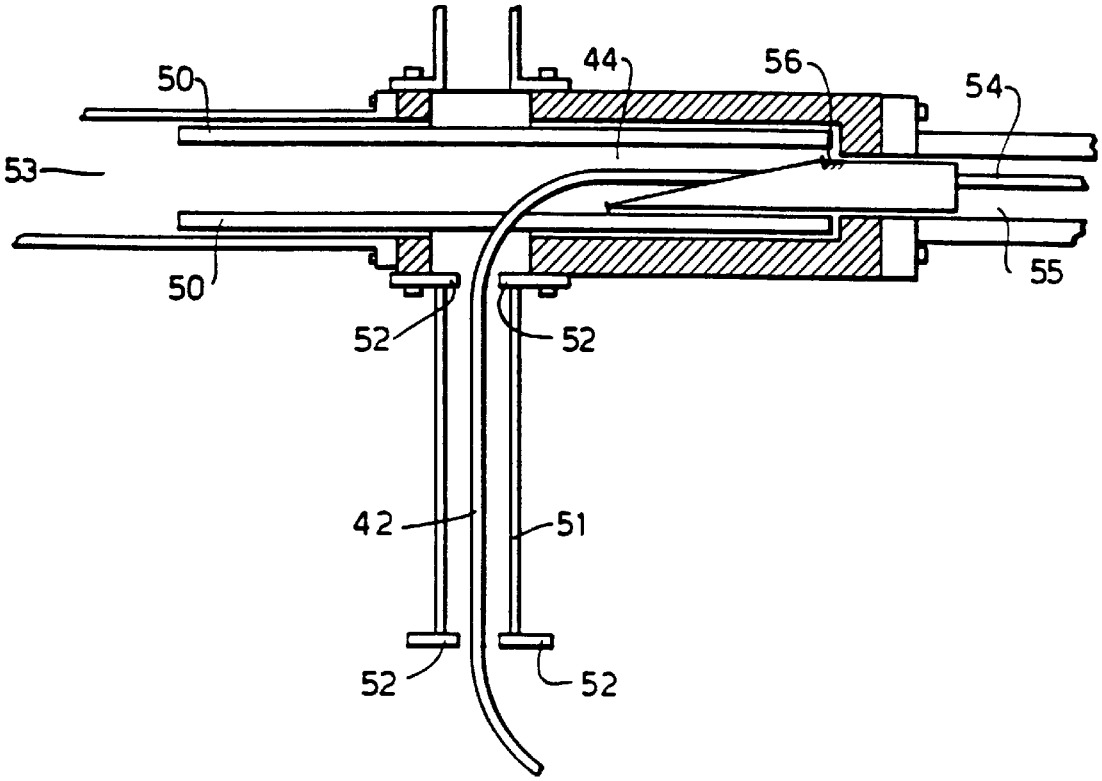
FIG. 7 shows schematically a fifth embodiment of a target in accordance with the present invention.

With the apparatus shown in FIG. 7, the target 40 is held by a target support 54 which extends through a target port 55 of the chamber 44. The target 40 is connected to the support 54 by resilient means 56, for example a spring, to allow for expansion and contraction of the target 40 as its temperature increases or decreases. Very little if any heat is conducted away from the target via the target support 54.

The incident beam 42 heats the molybdenum to temperatures in excess of 2000° C. At such temperatures the radiant heat loss equals the incident beam power and molybdenum evaporates form the surface of the target. The evaporated molybdenum reacts with the halogen or other compound and is redeposited as a metal onto the target. Where a halogen is present in the chamber, any volatilised molybdenum reacts with the halogen gas which is at low pressure (for example $10^{-4}$ mmHg) at the lower temperature of the target chamber (around 200°–400° C.) to form a molybdenum trihalide. Such molybdenum trihalides are known to decompose at greater than 1400° C., hence when the vapour contacts the hot (>2000° C.) target decomposition occurs replacing the molybdenum and regenerating halogen vapour. This provides a mechanism for ensuring that the valuable target material is not lost. It will of course be appreciated that the same effect is achieved whenever the surface of the target is at a temperature equal to or greater than the temperature of decomposition of the target material halide. In this case reference is made to >2000° C. as this is the temperature of the target as a result of its bombardment by the accelerated particles. The technetium 99 m, on the other hand, is volatilised as a halide and is deposited on the collector matrix 50. At suitable intervals the collector matrix 50 is replaced by a new matrix to collect further $^{99m}$Tc. Thus, the halogen atmosphere at low pressure performs a dual function. Firstly it helps remove the $^{99m}$Tc formed and secondly it provides a mechanism for returning any vapourised molybdenum to the target. It should be noted that as the halogen is present at very low pressure reaction with the proton beam is minimal. Any such minor reaction which does occur simply generates a non-radioactive inert gas (e.g. argon from chlorine, xenon from iodine etc.)

Reference has been made herein to halogen being present at low pressure within the chamber, this is intended as reference to the partial pressure of the halogen. Moreover, although it is preferable that the chamber is held at low pressure this is not essential. The target will function at higher pressures where the predominant gas in the chamber is non-reactive but the isotope can be produced much more efficiently at lower pressures.

With the apparatus described above with reference to FIG. 7, $^{99m}$Tc can be formed substantially continuously using particle beams at currents formerly considered impossible. In this respect it may be seen that, what was formerly considered to be an undesirable effect in $^{99m}$Tc generation, i.e. volatilisation, is now utilised in a simple yet effective manner. By bending the particle beam 42 and applying and orthogonal magnetic field, the volatile radioactive products generally are converted to a plasma form within the vacuum chamber 44 around the target region and do not feed back to contaminate the cyclotron or linear accelerator being used to generate the high energy ionised particles. In this respect the aluminium baffles 52 are provided to add to the shielding of the accelerator from the radioactive elements.

Alternative refractory target materials which may be employed are: Hafnium to produce tantalum isotopes, Iridium to produce Platinum, Niobium to produce molybdenum, Osmium to produce Iridium, Rhenium to produce Osmium, Rhodium to produce Palladium, Ruthenium to produce Rhodium, tantalum to produce Tungsten and Tungsten to produce Rhenium. In the case of Osmium and Ruthenium the target material is brittle which therefore makes it difficult to fabricate foils. In all of these cases the reactions are based on:

$$^{s}A(p,xn)^{s-(x-1)}B$$

$$^{s}A(d,xn)^{s-(x-2)}B$$

where A is the atomic number of the target species, B is the atomic number of the species generated, s=mass number, x=1,2,3, . . . indicating the number of displaced neutrons, p=proton, d=deuteron.

It will of course be apparent that the apparatus described can be adapted. For example, the support for the target may include means for altering the angle of the target to the beam path which enables the operating temperature of the target to be controlled. Also, the halogen which acts as a gaseous scavenger may be replaced by other gaseous elements and compounds able to perform the same role as exampled. Different arrangements of targets and isotope collectors may be implemented as well.

With the targets described, isotopes such as $^{99m}$Tc may be produced without the use of large heat sinks and at beam currents much higher than formerly used. Moreover, a greater purity of the isotope can be achieved making the targets particularly suited for use in the production of isotopes for medical applications.

We claim:

1. A superconducting cyclotron including superconducting magnetic means arranged to provide a magnetic field extending axially through a chamber including a radially extending beam space, interacting means located within the chamber to interact with the axially extending magnetic field and RF energising means for energising particles circulating within the beam space characterised by there being further provided a linear accelerator aligned with and exposed to the axially extending magnetic field of the superconducting cyclotron, the output of which communicates with an input to the beam space whereby particles for acceleration within the beam space are pre-accelerated by the linear accelerator.

2. A superconducting cyclotron as claimed in claim 1, wherein the linear accelerator is mounted within the chamber about the central axis of the chamber.

3. A superconducting cyclotron as claimed in claim 1, wherein the linear accelerator is a Wideroe accelerator.

4. A method of generating high energy particles comprising:

generating a magnetic field axially aligned with a chamber by means of superconducting magnetic means, adjusting the magnetic field within the chamber by means of interacting means to produce an azimuthal and an isochronus variation in the magnetic field with respect to the radial direction of the chamber, applying an RF oscillating voltage across a radially extending beam space in the chamber by means of RF energising means, injecting ionised particles into the beam space, accelerating the ionised particles within the beam space through the application of the RF oscillating voltage, characterised by pre-accelerating the ionised particles by passing the ionised particles through a linear accelerator which is aligned with and exposed to the axially extending magnetic field, before injecting the ionised particles into the beam space.

* * * * *